US012357059B2

(12) United States Patent
Sanders

(10) Patent No.: US 12,357,059 B2
(45) Date of Patent: Jul. 15, 2025

(54) SAFETY ASSISTIVE BELT FOR PATIENT TRANSFER

(71) Applicant: Tyrone Sanders, Willis, TX (US)

(72) Inventor: Tyrone Sanders, Willis, TX (US)

( * ) Notice: Subject to any disclaimer, the term of this patent is extended or adjusted under 35 U.S.C. 154(b) by 983 days.

(21) Appl. No.: 17/348,235

(22) Filed: Jun. 15, 2021

(65) Prior Publication Data

US 2022/0233369 A1 Jul. 28, 2022

Related U.S. Application Data

(63) Continuation-in-part of application No. 17/157,987, filed on Jan. 25, 2021, now abandoned.

(51) Int. Cl.
*A44B 11/25* (2006.01)

(52) U.S. Cl.
CPC ..... *A44B 11/2511* (2013.01); *A44B 11/2557* (2013.01)

(58) Field of Classification Search
CPC ..... A44B 11/2511; A44B 11/2557; A61G 7/1023
See application file for complete search history.

(56) References Cited

U.S. PATENT DOCUMENTS

| | | | | |
|---|---|---|---|---|
| 5,492,285 | A * | 2/1996 | Hamrick | A61F 5/04 242/384.7 |
| 5,979,026 | A * | 11/1999 | Anthony | A44B 11/2511 24/633 |
| 7,905,233 | B2 * | 3/2011 | Hopper | A61F 5/3776 128/869 |
| 9,016,608 | B2 * | 4/2015 | Bradley | B60R 22/36 242/385.4 |
| 2010/0115695 | A1 * | 5/2010 | White | A61G 7/1046 5/81.1 R |
| 2012/0011649 | A1 * | 1/2012 | Ophaug | A61G 7/1023 5/81.1 T |
| 2019/0001922 | A1 * | 1/2019 | Wang | B60R 22/18 |
| 2019/0133261 | A1 * | 5/2019 | Allen | B60R 22/34 |
| 2019/0208869 | A1 * | 7/2019 | Lee | B60R 22/18 |
| 2019/0380451 | A1 * | 12/2019 | Geist | A44B 11/065 |

* cited by examiner

*Primary Examiner* — David M Upchurch
(74) *Attorney, Agent, or Firm* — Jose W. Jimenez; Jimenez Law Firm

(57) ABSTRACT

Described herein is a retractable safety assistive belt assembly for use in transferring disabled or senior patients. The belt assembly includes a retractor assembly, a buckle mechanism, a latch member, a quick-release button, a strap or band member, and an optional belt clip attached to an external part of a housing. The strap or band member optionally includes measurement markers. In a related embodiment, an optional belt assembly case is provided for storage and portability of the belt assembly.

20 Claims, 16 Drawing Sheets

SAFETY ASSISTIVE BELT FOR PATIENT TRANSFER

CLAIM OF PRIORITY

This application is a continuation-in-part of U.S. patent application Ser. No. 17/157,987, filed on Jan. 25, 2021, and claims priority thereto, which claims priority to and the benefit of U.S. Provisional application with Ser. No. 62/967,012, filed on Jan. 28, 2020, both of which are incorporated herein by reference in their entireties.

FIELD OF THE INVENTION

The inventive concept relates generally to a safety assistive belt for use with disabled or senior patients.

BACKGROUND

Currently, there are a number of solutions for transferring people or patients who may need assistance when moving from a first location to another location. One of these solutions attempts to utilize gait belts, but this solution fails to meet the needs of the market because gait belts are not retractable or wearable for immediate assistance when transferring patients from one plane to another. Another solution attempts to utilize a personal lifting device, but this solution is similarly unable to meet the needs of the market because personal lifting devices are expensive and restricted to certain types of patients and require additional space. Still another solution seeks to employ human assistance, but this solution also fails to meet market needs because there may be no one to help. Therefore, there currently exists a need in the market for an apparatus that helps transfer patients from one location to another in a safe manner.

SUMMARY OF THE INVENTION

The inventive concept relates generally to a retractable safety assistive belt. It would be advantageous to have an apparatus for the assisted transference of patients that is retractable, is compact, and can be worn at all times. The disclosed inventive concept, also known as a "Ty Safety Belt," is accessible and clips onto a garment waistline or a beltline, the inventive concept readily available for use.

Still further, the inventive concept is designed for the transference of a patient and is lockable for the transference and releasable upon completion of transferring the patient.

The inventive concept advantageously fills the aforementioned deficiencies by providing a retractable safety assistive belt, which provides a way for caretakers to efficiently help move patients.

In one example embodiment, the inventive concept is a retractable belt assembly that includes a strap or band member that wraps around a patient. The strap or band member is attached at one end to a latch member and at the other end to a retractor assembly with the latch member being coupled to a buckle mechanism. The strap or band member rolls or is retracted into the retractor. In one embodiment, the retractor retracts the strap or band member via at least one coiled spring. In another embodiment, the retractor may operate via at least one electric motor. In another embodiment, the retractor may operate manually and can be pulled out to the desired waist length.

The strap or band member portion of the retractable belt assembly restrains the movement of the body part. The strap or band member eases the sought movement of the body. As one example, the strap or band member, by providing a handhold to a caregiver, allows the caregiver to guide the patient safely from a bed to a chair while preventing that person from falling. The inventive concept described herein fulfills the need for a patient assistance belt.

Among other things, it is an advantage of the inventive concept to provide a safety assistive belt that does not suffer from any of the problems or deficiencies associated with prior solutions.

In another embodiment, the strap or band member is made from synthetic materials such as nylon.

In one embodiment of the inventive concept, the strap or band member portion of the assembly has markings that allow for measurement, and the marking measurement is there to provide measurements for adaptive equipment needs, such as wheelchairs, walkers etc.

In one embodiment, the apparatus has a belt clip to be clipped on the waist or garment for the immediate assistive use when needed. In another embodiment, the apparatus has at least one quick-release button or lever. In yet another embodiment, the apparatus has at least one releasable hook.

It is still further an advantage of the inventive concept to have washable components. In one embodiment, the strap or band member is at least partly detachable from the retractor to facilitate replacement or such functions as maintenance and cleaning.

Still further, the inventive concept has a storage case with at least one clip disposed thereon to allow affixing the storage case to a garment or belt for easy accessibility and immediate use.

The present disclosure relates to an added embodiment of the assembly for supporting the safe transfer of a person from one location to another. A housing assembly defines and substantially contains the buckle mechanism. A retractable strap or band member is adapted to be at least partially disposed inside the housing assembly at a proximal end of the strap or band member, the proximal end of the strap or band member disposed through a distal slot portion of the housing assembly. The proximal end of the strap or band member is operatively coupled to the retractor assembly disposed within the housing assembly, Matching measurement indicators displayed on at least one or more of the inner surface and the outer surface of the strap or band member are adapted to adjust the strap or band member for the girth of the person when the strap or band member is at least partly extended. The latch member is coupled to the distal end of the strap or band member. The buckle member of the buckle mechanism is disposed within the housing assembly and is designed to secure the latch member to the buckle mechanism, the buckle member adapted to release the latch member from the buckle mechanism when the depressible spring and button member disposed on the housing assembly is depressed, the latch member, when in a resting state, secured by a spring-loaded bolt member through an eyelet of the latch member, the latch member designed to be inserted in a proximal slot portion of the housing assembly.

In this added embodiment, the retractor assembly further has a retractor and locking mechanism having a retract bracket, a retract gear, a retract shaft, a locking plate, the at least one coiled spring member, and a spacer member, the locking mechanism designed to allow the strap or band member to lock at any one of a plurality of circumferences. A locking switch mechanism is designed to maintain and release the selected circumference of the strap or band member.

In this added embodiment of the assembly for supporting the safe transfer of a person from one location to another, the retractor member is substantially a cylinder. The measurement indicators include both metric and English units. The strap or band member is substantially made from nylon. The buckle mechanism, the latch member, and buckle member incorporate 6061 Aluminum. The latch member is substantially covered by a polymer coating. A clip member is affixed to a back surface of the housing assembly defining the buckle mechanism. Alternatively, at least one belt loop member may be affixed to the back surface of the housing assembly defining the buckle mechanism. The clip member is at least partly covered by a polymer coating. A cover member may be pivotally coupled to the housing assembly designed, when in a closed state, to prevent depressing the button member.

In this added embodiment, one or more removable clip or loop members may be disposed on the strap or band member designed to provide coupling points for at least one or more of a leg support strap or band member and a shoulder harness strap or band member. Each may be disposed together or apart within a separate housing assembly designed to be in an open or closed state, having at least one clip member disposed on a back side of the separate housing assembly designed to be removably coupled to a belt or garment member, the separate housing assembly further designed to carry a separate strap or band member designed to circumscribe a waist. Supplementary connector straps or bands may be included.

In this added embodiment, a supplementary housing assembly may be designed to be removably coupled to a belt or garment member by at least one clip member disposed on a back side of the supplementary housing assembly. This embodiment is designed to carry a separate strap or band member designed to circumscribe a waist and may be used together or apart from the housing assembly defining the buckling mechanism.

Another added embodiment is a method for supporting the safe transfer of a person from one location to another. The method includes pulling from the housing assembly defining the buckle mechanism the retractable strap or band member designed to be at least partially disposed inside the housing assembly at the proximal end of the strap or band member, the proximal end of the strap or band member disposed through the distal slot portion of the housing assembly. The method further includes drawing the strap or band member around the person to the length of at least one or more of substantially the person's waist and matching measurement indicators displayed on at least one or more of the inner surface and the outer surface of the strap or band member, the strap or band member designed to be adjusted to the girth of the person when the strap or band member is at least partly extended.

In this added embodiment, the method includes coupling the latch member coupled to the distal end of the strap or band member to the buckle member of the buckle mechanism disposed within the housing assembly to secure the latch member to the buckle mechanism, the buckle member designed to release the latch member from the buckle mechanism when the depressible spring and button member disposed on the housing assembly is depressed, releasing the latch member from the spring-loaded bolt member, the latch member designed to be inserted in the proximal slot portion of the housing assembly facing the latch member. The method further includes engaging the retractor assembly further having the retractor and locking mechanism having the retract bracket, the retract gear, the retract shaft, the locking plate, the at least one coiled spring member, and the spacer member, the locking mechanism locking the strap or band member at one of the plurality of potential circumferences. The method further includes engaging the locking mechanism to maintain the selected circumference of the strap or band member. The method may further include a cover member that is rendered into an open state to expose the button member and is rendered into a closed state after engaging the locking switch. The method may further include a step wherein the housing assembly is first secured by the clip member to one or more of the belt or garment member.

In this added embodiment, the method includes the retracting and locking mechanism having the retractor assembly, a retract gear, a retract shaft, a locking plate, the at least one coiled spring member, and a spacer, each substantially constructed out of metal to accommodate the strength requirements, such as 6061 Aluminum, to provide strength, hardness, and non-corrosive properties at an affordable cost. This embodiment is comparable to a standard seatbelt assembly. Substantially, the strap or band member can be pulled out with infinite variability due to the constant retract force being applied. This operation will allow the strap or band member to be placed around patients of most sizes. Once the strap or band member is fitted around the patient, the mechanical locking switch (comparable to a tape measure locking switch) can be moved into a position that will cause the locking plate to come into contact with the retract gear causing the strap or band member to become fixed. Once the strap or band member is fixed, a person can aid in the moving another person from plane to plane. The strap or band member may also be termed a belt.

The inventive concept now will be described more fully hereinafter with reference to the accompanying drawings, which are intended to be read in conjunction with both this summary, the detailed description, and any preferred and/or particular embodiments specifically discussed or otherwise disclosed. This inventive concept may, however, be embodied in many different forms and should not be construed as limited to the embodiments set forth herein; rather, these embodiments are provided by way of illustration only and so that this disclosure will be thorough, complete, and will fully convey the full scope of the inventive concept to those skilled in the art.

DETAILED DESCRIPTION OF THE INVENTION

Figure 1:
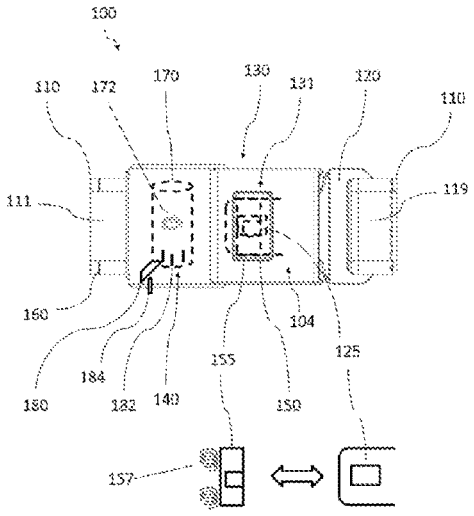
FIG. 1 illustrates a front view of a first embodiment of a retractable belt assembly according to the teachings herein.
Figure 2:
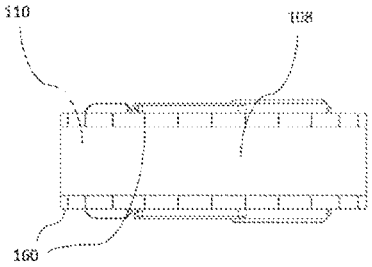
FIG. 2 illustrates a back view of the retractable belt assembly.
Figure 3:
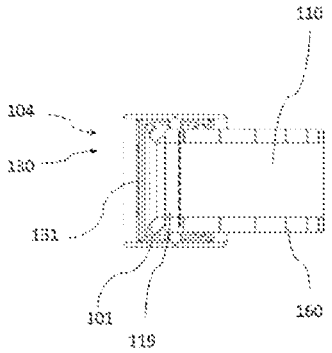
FIG. 3 illustrates a partially right side view of the retractor belt assembly.
Figure 4:
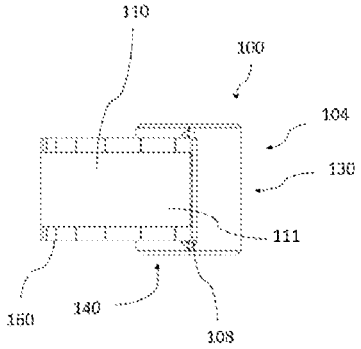
FIG. 4 illustrates a partially left side view of the retractor belt assembly.
Figure 5:
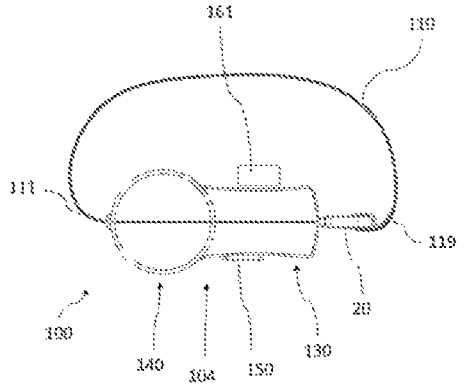
FIG. 5 illustrates a top view of the retractable belt assembly.
Figure 6:
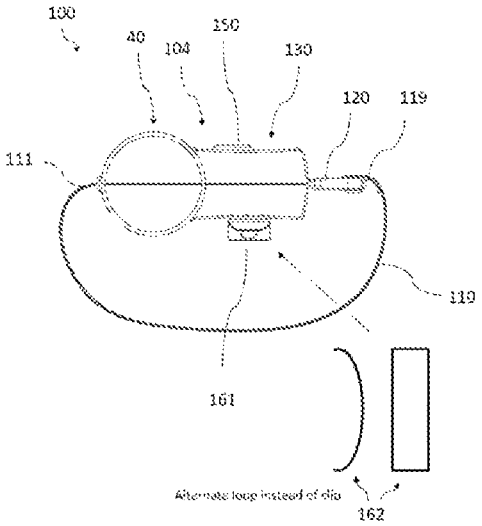
FIG. 6 illustrates a bottom view of the retractable belt assembly.
Figure 7:
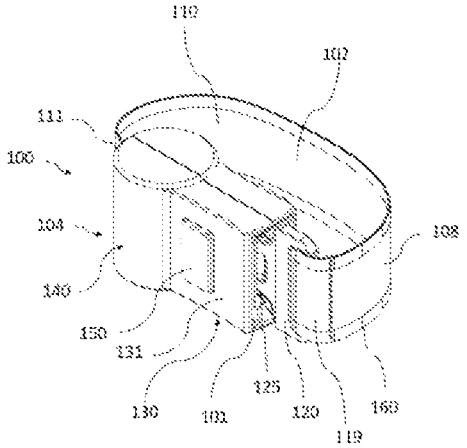
FIG. 7 illustrates a perspective view of the retractable belt assembly.
Figure 8:
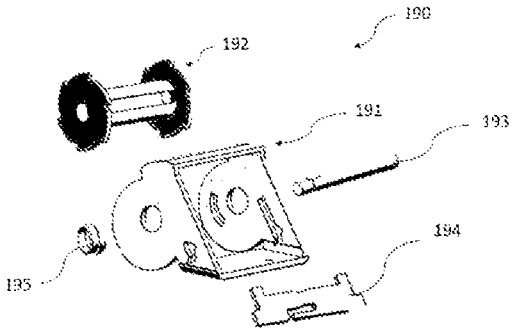
FIG. 8 illustrates retractor and locking mechanism elements of the retractable belt assembly.

Following are more detailed descriptions of various related concepts related to, and embodiments of, methods and apparatus according to the present disclosure. It should be appreciated that various aspects of the subject matter introduced above and discussed in greater detail below may be implemented in any of numerous ways, as the subject matter is not limited to any particular manner of implementation. Examples of specific implementations and applications are provided primarily for illustrative purposes.

The various embodiments of the inventive concept include a retractable safety assistive belt and related accessories.

Referring to the figures, FIGS. 1-8 illustrate views of one embodiment of the retractable belt assembly device that includes a strap or band member 110 that is attached at one end by a latch member 120 and a retractor assembly 140. The latch member 120 is insertable into a buckle mechanism 130 whereupon it is secured by a spring-loaded bolt member 155 through the eyelet 125 of the latch member 120. A front-facing button member 150 when pressed depresses an at least one spring 157 extending the spring-loaded bolt member 155 and allows the release of the latch member 120 from the buckle mechanism 130. The strap or band member 110 rolls into the retractor assembly 140 onto a retractor cylinder member 170 via at least one coiled retractor spring 172 and is arrested by a claw 180 and a set of gears 182. The claw 180 has a locking switch mechanism 184. The strap or band member 110 optionally includes measurement marks 160.

Figure 9A:
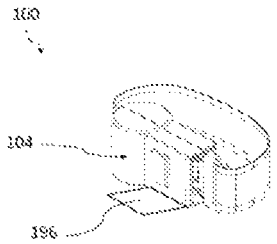
FIGS. 9A and 9B illustrate a perspective view of an open and shut button cover, respectively, of the retractable belt assembly.
Figure 9B:
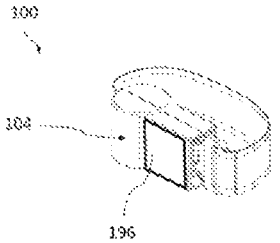

FIGS. 9A and 9B illustrate one embodiment of a cover member 196 which may be pivotally coupled to the housing assembly 104 designed, when in a closed state, to prevent depressing the button member 150. The cover member 196 may be pivotally coupled to the housing assembly 100 or, with reference to FIG. 10, other embodiments of the housing assembly such as 300, where it can best cover the button member 150 or other embodiments of the button member such as, with reference to FIGS. 12-19, 350.

Figure 10:
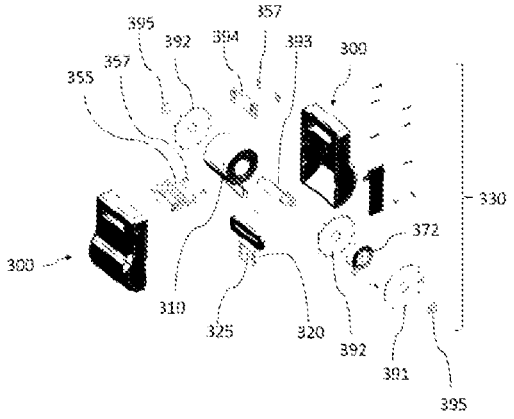
FIG. 10 illustrates an exploded view of a housing assembly and the interior of the retractor and locking mechanism elements of the improved retractable belt assembly.

FIG. 10 illustrates another embodiment of an assembly 300 for supporting the safe transfer of a person from one location to another. A housing assembly 305 defines part of the buckle mechanism 330. A retractable strap or band member 310 is designed to be at least partially disposed inside the housing assembly 305 at a proximal end of the strap or band member 311 (not shown but similar to band 110 of assembly 100), the proximal end of the strap or band member 311 disposed through a distal slot portion of the housing assembly 305. The proximal end of the strap or band member 311 is operatively coupled to retractor assembly 340 (not shown but similar to assembly 140 described above) disposed within the housing assembly 305. Matching measurement indicators 360 (not shown but similar to indicators 160 of assembly 140) displayed on at least one or more of the inner surface and the outer surface of the strap or band member 308, 302 (similar to the at least one or more of the inner surface and the outer surface of the strap or band member 108, 102) and are designed to adjust the strap or band member 310 for the girth of the person when the strap or band member is at least partly extended. A latch member 320 is coupled to a distal end of the strap or band member 311 (similar to the latch member 120 coupled to the distal end of the strap or band member 111). The buckle member 331 (not shown) (similar to the buckle member 131) of the buckle mechanism 330 is disposed within the housing assembly 30*o* designed to secure the latch member 320 to the buckle mechanism 330, the buckle member 331 designed to release the latch member 320 from the buckle mechanism 330 when a depressible at least one spring 357 similar to the at least one depressible spring 157 and the button member 350 (not shown) disposed on the housing assembly 305 is depressed, the latch member, when in a resting state, secured by a spring-loaded bolt member 355 through an eyelet 325 of the latch member 320, the latch member 320 designed to be inserted in a proximal slot portion of the housing assembly 301.

This embodiment further utilizes a retractor assembly 340, similar to the one disclosed in FIGS. 1-8, further having a retractor and locking mechanism 390 having a retract bracket 391, a retract gear 392, a retract shaft 393, a locking plate 394, the at least one coiled spring member 372, and a spacer member 395, the locking mechanism 390 designed to allow the strap or band member 310 to lock at any one of a plurality of circumferences. A locking switch mechanism 384 is designed to maintain and release the selected circumference of the strap or band member 310.

Referring again to FIG. 10, which is a second and improved embodiment of the safety assistive transport assembly 300 for supporting the safe transfer of a person from one location to another, the retractor member 370 is substantially a cylinder. The measurement indicators 360 include both metric and English units. The strap or band member 310 is substantially made from nylon. The buckle mechanism 330, the latch member 320, and buckle member 331 incorporate 6061 Aluminum. The latch member 320 is substantially covered by a polymer coating. A clip member 361 (not shown) is affixed to a back surface of the housing assembly 300 defining the buckle mechanism 330. Alternatively, at least one belt loop member 362 may be affixed to the back surface of the housing assembly 309 defining the buckle mechanism 330. The clip member 361 may be at least partly covered by a polymer coating. With reference to FIG. 9A, embodiment 300 can also include a cover member 196 that may be pivotally coupled to the front face of the housing assembly 104 designed, when in a closed state, to prevent depressing the front-facing button member 150.

Figure 11:
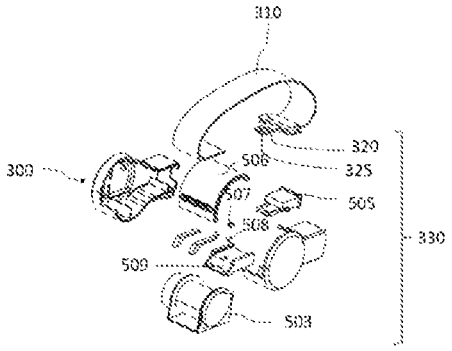
FIG. 11 illustrates added retractor and locking mechanism elements of the improved retractable belt assembly.
Figure 12:
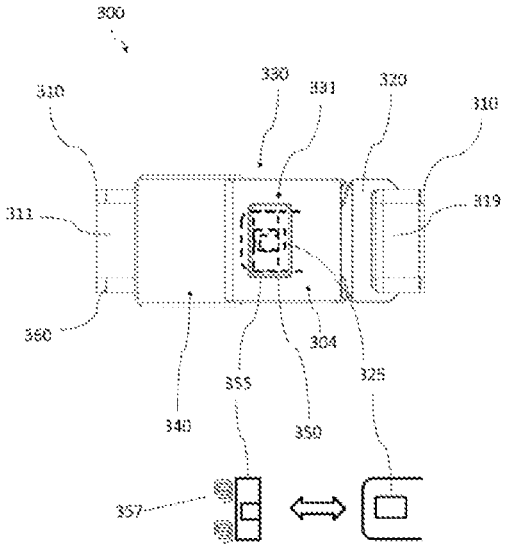
FIG. 12 illustrates a front view of an improved embodiment of a retractable belt assembly according to the teachings herein.
Figure 13:
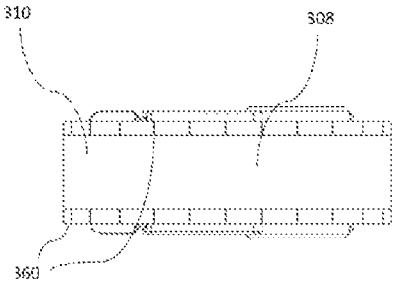
FIG. 13 illustrates a back view of the improved retractable belt assembly.
Figure 14:
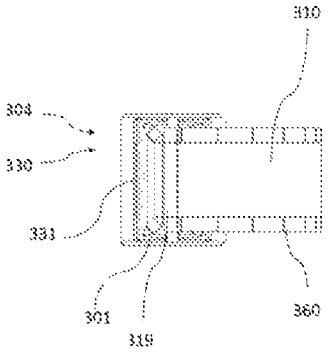
FIG. 14 illustrates a partially right side view of the improved retractor belt assembly.
Figure 15:
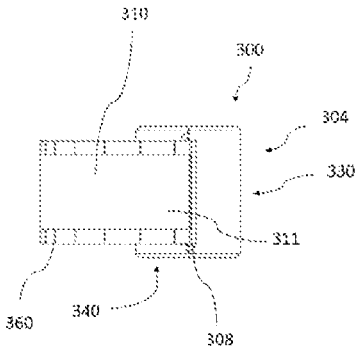
FIG. 15 illustrates a partially left side view of the improved retractor belt assembly.
Figure 16:
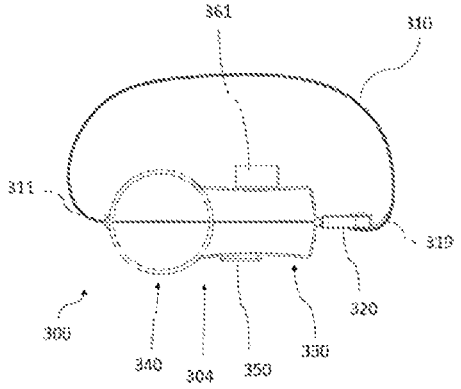
FIG. 16 illustrates a top view of the improved retractable belt assembly.
Figure 17:
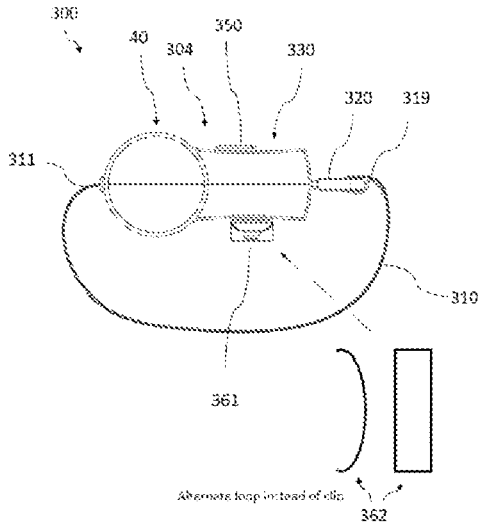
FIG. 17 illustrates a bottom view of the improved retractable belt assembly.
Figure 18:
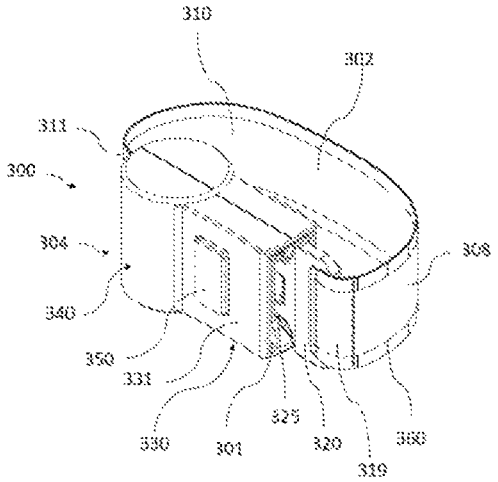
FIG. 18 illustrates a perspective view of the improved retractable belt assembly.
Figure 19:
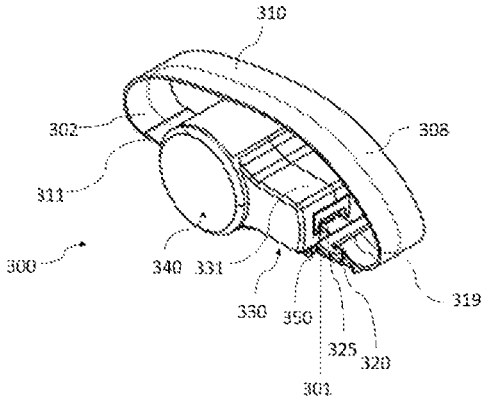
FIG. 19 illustrates a perspective view of another embodiment of the improved retractable belt assembly.

FIG. 11 illustrates that the second improved embodiment may include a retractable mechanism 503, at least one locking arm 504, a lock member 505, a strap cover 506, at least one first screw 507, at least one second screw 508, and at least one locking arms base 509.

The embodiment of the inventive concept illustrated in FIGS. 10-18A and 18B includes the improved retracting and locking mechanism 390 having the retractor assembly 340, a retract gear 392, a retract shaft 393, a locking plate 394, the at least one coiled spring member 372, and a spacer 395. The elements illustrated in FIG. 10-18 are substantially constructed out of metal to accommodate the strength requirements, such as 6061 Aluminum, to provide strength, hardness, and non-corrosive properties at an affordable cost. This embodiment is comparable to a standard seatbelt assembly. Substantially, the strap or band member 310 can be pulled out with infinite variability due to the constant retract force being applied. This operation will allow the strap or band member 310 to be placed around a patient of most sizes. Once the strap or band member 310 is fitted around the patient, the mechanical locking switch 384 (comparable in operation to a tape measure locking switch and designed to operably conform to associated mechanisms of the retractor assembly 340) can be moved into a position that will cause the locking plate 394 to come into contact with the retract gear 392 causing the strap or band member 310 to become fixed. Once the strap or band member 310 is fixed, a person can aid in the moving the inventive concept from plane to plane.

Referring to the figures, FIGS. 12-19 further illustrate the second and improved embodiment of the retractable belt assembly device that includes a strap or band member 310 that is attached at one end by a latch member 320 and a retractor assembly 340. The latch member 320 is insertable into a buckle mechanism 330 whereupon it is secured by a spring-loaded bolt member 355 through the eyelet 325 of the latch member 320. The button member 350 when pressed depresses an at least one spring 357 extending the spring-loaded bolt member 355 and allows the release of the latch member 320 from the buckle mechanism 330. The strap or band member 310 rolls into the retractor assembly 340. The strap or band member 310 optionally includes measurement marks 360.

Figure 20:
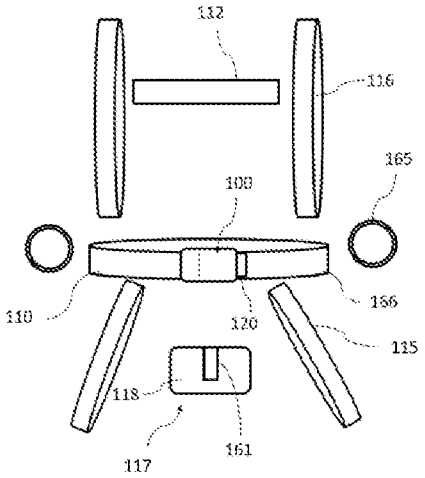
FIG. 20 illustrates leg and shoulder strap or band member options of the retractable belt assembly.
Figure 21:
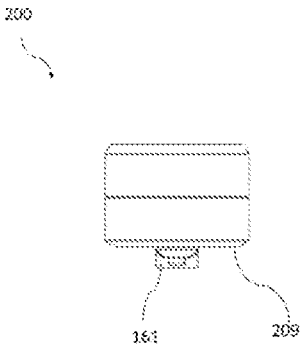
FIG. 21 illustrates the front view of the supplementary storage case.
Figure 22:
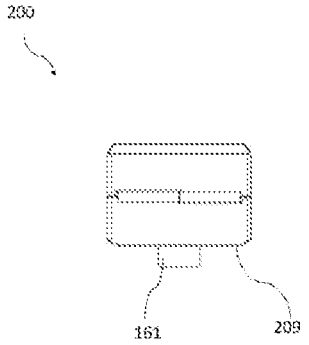
FIG. 22 illustrates the back view of the supplementary storage case.
Figure 23:
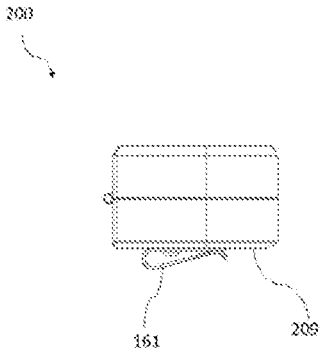
FIG. 23 illustrates the left side view of the supplementary storage case.
Figure 24:
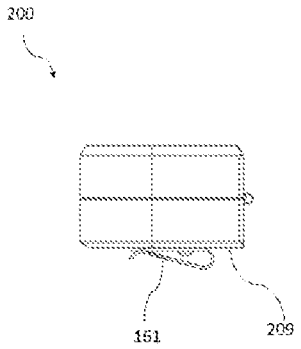
FIG. 24 illustrates the right-side view of the supplementary storage case 8
Figure 25:
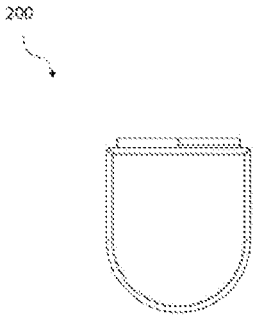
FIG. 25 illustrates the top view of the supplementary storage case.
Figure 26:
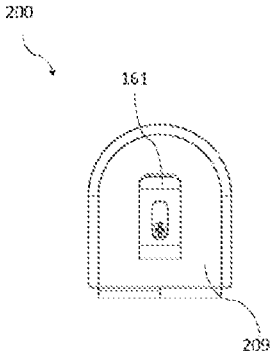
FIG. 26 illustrates the bottom view of the supplementary storage case.
Figure 27:
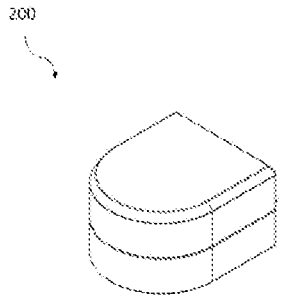
FIG. 27 illustrates a perspective view of the supplementary storage case with the holder clip.
Figure 28:
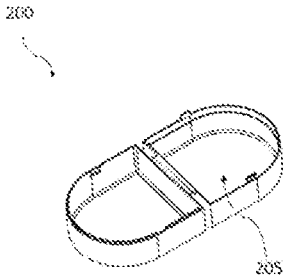
FIG. 28 illustrates an interior perspective view of a retracting and locking mechanism for the assistive belt.

FIG. 20 illustrates that one or more removable clip or loop members 165 may be disposed on the strap or band member 110 designed to provide coupling points 166 for at least one or more of a leg support strap or band member 115 and a shoulder harness strap or band member 116. Each may be disposed together or apart within a separate housing assembly 117 designed to be in an open or closed state, having at least one clip member 161 disposed on a back side of the separate housing assembly 118 designed to be removably coupled to a belt or garment member, the separate housing assembly 117 further designed to carry a separate strap or band member designed to circumscribe a waist. Supplementary connector straps or bands 112 may be included.

FIG. 21-28 illustrates an example embodiment that has a supplementary housing assembly 200. The supplementary housing assembly 200 is designed to contain a separate strap or band member adapted to circumscribe a waist contained in an interior portion of the supplementary housing assembly 205. At least one clip member 161 may be disposed on a back side of the supplementary housing assembly 209. The supplementary housing assembly 200 and separate strap or band member may be used together or apart from the housing assembly 100 defining the buckling mechanism 130.

Figure 29A:
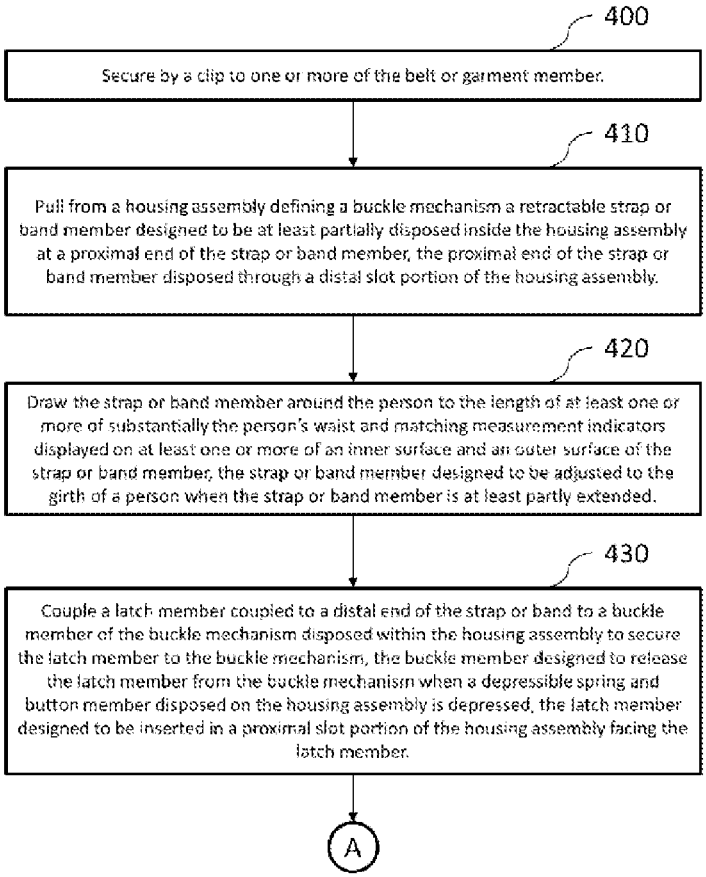
FIG. 29A-29B illustrates a flowchart of a method of using the retractable belt assembly.
Figure 29B:
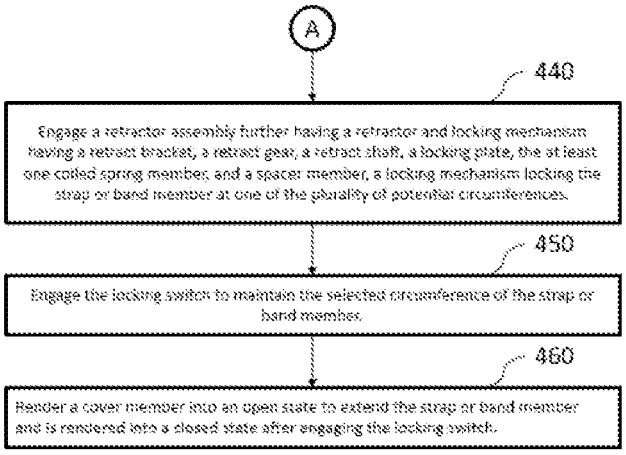

FIGS. 29A-29B illustrates a method for supporting the safe transfer of a person from one location to another. The method includes 410 pulling from the housing assembly 300 defining the buckle mechanism 330 the retractable strap or band member 310 designed to be at least partially disposed inside the housing assembly 300 at the proximal end of the strap or band member 311, the proximal end of the strap or band member 311 disposed through the distal slot portion of the housing assembly 309. The method further includes 420 drawing the strap or band member 310 around the person to the length of at least one or more of substantially the person's waist and matching measurement indicators 360 displayed on at least one or more of the inner surface 302 and the outer surface 308 of the strap or band member 310, the strap or band member 310 designed to be adjusted to the girth of the person when the strap or band member 310 is at least partly extended.

FIG. 29A-29B further illustrates that the method includes 430 coupling the latch member 320 coupled to the distal end of the strap or band member 319 to the buckle member 331 of the buckle mechanism 330 disposed within the housing assembly 300 to secure the latch member 320 to the buckle mechanism 330, the buckle member 331 designed to release the latch member 320 from the buckle mechanism 330 when the depressible spring and button member 350 disposed on the housing assembly 304 is depressed, releasing the latch member 320 from the spring-loaded bolt member 355, the latch member 320 designed to be inserted in the proximal slot portion of the housing assembly 301 facing the latch member 320. The method further includes 440 engaging the retractor assembly 340 further having the retractor and locking mechanism 390 having the retract bracket 391, the retract gear 392, the retract shaft 393, the locking plate 394, the at least one coiled spring member 372, and the spacer member 395, the locking mechanism 390 locking the strap or band member 310 at one of the plurality of potential circumferences. The method further includes 450 engaging the locking mechanism to maintain the selected circumference of the strap or band member 310. The method may further include 460 the cover member 396 that is rendered into an open state to expose the button member 350 and is rendered into the closed state after engaging the locking switch 384. The method may first include 400 wherein the housing assembly 300 is first secured by the clip member 361 to one or more of the belt or garment member.

The following patents are incorporated by reference in their entireties: U.S. Pat. Nos. 4,132,229, 6,076,527, and 5,626,398.

While the inventive concept has been described above in terms of specific embodiments, it is to be understood that the inventive concept is not limited to these disclosed embodiments. Upon reading the teachings of this disclosure, many modifications and other embodiments of the inventive concept will come to mind of those skilled in the art to which this inventive concept pertains, and which are intended to be and are covered by both this disclosure and the appended claims. It is indeed intended that the scope of the inventive concept should be determined by proper interpretation and construction of the appended claims and their legal equivalents, as understood by those of skill in the art relying upon the disclosure in this specification and the attached drawings.

The invention claimed is:

1. An assembly for supporting the safe transfer of a person from one location to another comprising:

a strap or band member;

a set of measurement indicators displayed on a surface of the strap or band member to match the girth of a person that is to be circumscribed when the strap or band member is extended;

a latch member coupled to a distal end of the strap or band member;

a retractor assembly coupled to a proximal end of the strap or band member;

a buckle mechanism operatively coupled to the retractor assembly, a buckle member of the buckle mechanism adapted to secure the latch member to the buckle mechanism, the latch member insertable into the buckle mechanism and securable by a spring-loaded bolt member extended through an eyelet of the latch member;

a front-facing button member that when pressed depresses an at least one spring extending the spring-loaded bolt member and allows the release of the latch member from the buckle mechanism, the buckle member adapted to release the latch member from the buckle mechanism;

a retractor cylinder member operably coupled to at least one coiled retractor spring; and a claw adapted for engaging a protrusion or a depression on the retractor cylinder member in the retractor assembly, the claw adapted to arrest strap or band member movement.

2. The assembly for supporting the safe transfer of a person from one location to another of claim 1 wherein the claw includes a locking mechanism.

3. The assembly for supporting the safe transfer of a person from one location to another of claim 1 wherein a clip is affixed to the buckle mechanism.

4. The assembly for supporting the safe transfer of a person from one location to another of claim 1 wherein a supplementary housing assembly, which may be used apart from the housing assembly defining the buckle mechanism, is adapted to contain a separate strap or band member adapted to circumscribe a waist.

5. The assembly for supporting the safe transfer of a person from one location to another of claim 4 wherein the supplementary housing assembly is adapted to be removably coupled to a belt or garment member by at least one clip member disposed on a back side of the supplementary housing assembly.

6. An assembly for supporting the safe transfer of a person from one location to another comprising:

a housing assembly defining a buckle mechanism;

a retractable strap or band member adapted to be at least partially disposed inside the housing assembly at a proximal end of the strap or band member, the proximal end of the strap or band member disposed through a distal slot portion of the housing assembly;

the proximal end of the strap or band member operatively coupled to a retractor assembly disposed within the housing assembly;

matching measurement indicators displayed on at least one or more of an inner surface and an outer surface of the strap or band member adapted to adjust the strap or band member for the girth of the person when the strap or band member is at least partly extended;

a latch member coupled to a distal end of the strap or band member;

a buckle member of the buckle mechanism disposed within the housing assembly adapted to secure the latch member to the buckle mechanism, the buckle member adapted to release the latch member from the buckle mechanism when a depressible spring and button member disposed on the housing assembly is depressed, the latch member, when in a resting state, secured by a spring-loaded bolt member through an eyelet of the latch member, the latch member adapted to be inserted in a proximal slot portion of the housing assembly;

the retractor assembly further having a retractor and locking mechanism having a retract bracket, a retract gear, a retract shaft, a locking plate, at least one coiled spring member, and a spacer member, the locking mechanism adapted to allow the strap or band member to lock at any one of a plurality of circumferences; and a locking switch member adapted to maintain and release the selected circumference of the strap or band member.

7. The assembly for supporting the safe transfer of a person from one location to another of claim 6 wherein the retractor member is substantially a cylinder.

8. The assembly for supporting the safe transfer of a person from one location to another of claim 6 wherein the measurement indicators include both metric and English units.

9. The assembly for supporting the safe transfer of a person from one location to another of claim 6 wherein the strap or band member is substantially made from nylon and at least the buckle mechanism, the latch member, and buckle member incorporate 6061 Aluminum.

10. The assembly for supporting the safe transfer of a person from one location to another of claim 6 wherein a clip is affixed to a back surface of the housing assembly defining the buckle mechanism.

11. The assembly for supporting the safe transfer of a person from one location to another of claim 6 wherein the retractor and locking mechanism has at least one or more of a retractable mechanism, at least one locking arm, a lock member, a strap cover, at least one first screw, at least one second screw, and at least one locking arms base.

12. The assembly for supporting the safe transfer of a person from one location to another of claim 6 wherein at least one belt loop member is affixed to the back surface of the housing assembly defining the buckle mechanism.

13. The assembly for supporting the safe transfer of a person from one location to another of claim 6 wherein a cover member is pivotally coupled to the housing assembly adapted, when in a closed state, to prevent depressing the button member.

14. The assembly for supporting the safe transfer of a person from one location to another of claim 6 wherein at least one or more of a removable clip or loop member is disposed on the strap or band member adapted to provide coupling points for at least one or more of a leg support strap or band member and a shoulder harness strap or band member.

15. The assembly for supporting the safe transfer of a person from one location to another of claim 14 wherein the at least one or more of a removable clip or loop member is disposed on the strap or band member adapted to provide coupling points for at least one or more of the leg support strap or band member and the shoulder harness strap or band member each disposed together or apart within a separate housing assembly, the separate housing assembly having at least one clip member disposed on a back side of the separate housing assembly adapted to be removably coupled to a belt or garment member.

16. The assembly for supporting the safe transfer of a person from one location to another of claim 6 wherein a supplementary housing assembly, which may be used apart from the housing assembly defining the buckle mechanism, is adapted to contain a separate strap or band member adapted to circumscribe a waist.

17. The assembly for supporting the safe transfer of a person from one location to another of claim 16 wherein the supplementary housing assembly is adapted to be removably coupled to a belt or garment member by at least one clip member disposed on a back side of the supplementary housing assembly.

18. A method for supporting the safe transfer of a person from one location to another, the method comprising:

pulling from a housing assembly defining a buckle mechanism a retractable strap or band member adapted to be at least partially disposed inside the housing assembly at a proximal end of the strap or band member, the proximal end of the strap or band member disposed through a distal slot portion of the housing assembly;

drawing the strap or band member around the person to a length of at least one or more of substantially the person's waist and matching measurement indicators displayed on at least one or more of an inner surface and an outer surface of the strap or band member, the strap or band member adapted to be adjusted to the girth of the person when the strap or band member is at least partly extended;

coupling a latch member coupled to a distal end of the strap or band member to a buckle member of the buckle mechanism disposed within the housing assembly to secure the latch member to the buckle mechanism, the buckle member adapted to release the latch member from the buckle mechanism when a depressible spring and button member disposed on the housing assembly is depressed, releasing the latch member from a spring-loaded bolt member, the latch member adapted to be inserted in a proximal slot portion of the housing assembly facing the latch member;

engaging the retractor assembly further having a retractor and locking mechanism having a retract bracket, a retract gear, a retract shaft, a locking plate, at least one coiled spring member, and a spacer member, the locking mechanism locking the strap or band member at one of a plurality of potential circumferences; and engaging the locking mechanism to maintain the selected circumference of the strap or band member.

19. The method for supporting the safe transfer of a person from one location to another of claim 18 wherein the housing assembly is first secured by a clip to one or more of a belt or garment member.

20. The method for supporting the safe transfer of a person from one location to another of claim 18 wherein a cover member is rendered into an open state, allowing the button member to be depressed, and is rendered into a closed state after engaging the locking switch.

* * * * *